US006843303B2

(12) United States Patent
Siak et al.

(10) Patent No.: US 6,843,303 B2
(45) Date of Patent: Jan. 18, 2005

(54) METHOD OF SAND COREMAKING

(75) Inventors: June-Sang Siak, Troy, MI (US); Gordon Alwin Tooley, Saginaw, MI (US); Mei Cai, Bloomfield Hills, MI (US); Richard Michael Schreck, West Bloomfield, MI (US); William Thomas Whited, Saginaw, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/358,133

(22) Filed: Feb. 4, 2003

(65) Prior Publication Data

US 2004/0149416 A1 Aug. 5, 2004

(51) Int. Cl.[7] ..... B22C 9/12; B22C 1/16

(52) U.S. Cl. ..... 164/12; 164/48; 164/250.1

(58) Field of Search ..... 164/12, 16, 48, 164/492, 498, 147.1, 250.1, 192

(56) References Cited

U.S. PATENT DOCUMENTS

| | | | | | |
|---|---|---|---|---|---|
| 3,429,359 | A | * | 2/1969 | Hollingsworth | 164/37 |
| 3,692,085 | A | * | 9/1972 | Brown et al. | 164/15 |
| 4,331,197 | A | * | 5/1982 | Cole | 164/522 |
| 4,763,720 | A | * | 8/1988 | Sakamoto et al. | 164/525 |
| 4,766,771 | A | * | 8/1988 | Bailey et al. | 74/61 |
| 4,784,206 | A | * | 11/1988 | Sauerman et al. | 164/18 |
| 5,320,157 | A | | 6/1994 | Siak et al. | |
| 5,837,373 | A | * | 11/1998 | Siak et al. | 428/404 |
| RE36,001 | E | | 12/1998 | Siak et al. | |
| 6,467,525 | B2 | * | 10/2002 | Herreid et al. | 164/12 |
| 6,505,671 | B1 | * | 1/2003 | McKibben et al. | 164/12 |

FOREIGN PATENT DOCUMENTS

| | | | |
|---|---|---|---|
| EP | 0 608 926 | 8/1994 | B22C/1/02 |
| JP | 56080350 | 7/1981 | B22C/09/12 |
| JP | 58009743 | 1/1983 | B22C/9/02 |
| JP | 58100938 | 6/1983 | B22C/1/18 |
| JP | 59144551 | 8/1984 | B22C/1/22 |
| JP | 59156536 | 9/1984 | B22C/7/06 |
| JP | 01127141 | 5/1989 | B22C/9/12 |
| WO | 97/18913 | 5/1997 | B22C/1/22 |

* cited by examiner

*Primary Examiner*—Kiley Stoner
*Assistant Examiner*—Kevin P. Kerns
(74) *Attorney, Agent, or Firm*—Kathryn A. Marra

(57) ABSTRACT

A method for making sand particle foundry mold members. Sand particles are coated with an aqueous dispersion of a suitable binder material such as a gelatin gel. The moist gelatin coated particles are gravity fed into a pattern box for the mold member and subjected to multi-axis vibration to pack the sand in the pattern box. The moist sand is then heated with radio frequency energy to promote binder flow to the corners of the particles, and air flow is initiated to transport water from the mass of particles to harden the mass of particles into the mold member.

14 Claims, 2 Drawing Sheets

METHOD OF SAND COREMAKING

TECHNICAL FIELD

This invention pertains to making sand cores or other mold parts used in castings. More specifically, this invention pertains to making sand cores with a liquid (e.g., water) soluble or water dispersible binder where reusable core molds are filled with moist, binder coated sand using gravity feed and vibration packing, and the moist binder coated sand is heated in the molds to dry and/or cure the binder using radio frequency electromagnetic radiation.

BACKGROUND OF THE INVENTION

U.S. Reissue Pat. No. 36,001, Sand Mold Member and Method, Siak et al, assigned to the assignee of this invention, is representative of a group of patents describing the use of aqueous sols of gelatins as a bio-degradable binder material in making foundry mold members. Such water soluble binders permit recovery and reuse of the sand used to make the cores and other mold bodies and they reduce pollutant emissions. There is a need in the foundry art for a faster and less expensive method of making a molded sand mold member using these gelatin binders or other water dispersed resin binders. It is an object of this invention to provide such a process.

SUMMARY OF THE INVENTION

This invention provides an efficient method of molding sand particles coated with a water-dispersed binder into a foundry core or other mold member for metal casting. The practice of the invention is illustrated by reference to common silica sands but other sands and other particulate refractory materials, such as zircon or ceramic particles, used in casting molds for molten metals are intended to be included in the term "sand" as used in this specification.

In a preferred embodiment of the invention the individual sand particles are coated with an aqueous gelatin sol and, upon suitable activation and drying, the gelatin becomes the binder material for a strong, durable particulate sand body for foundry usage. But the method is applicable to any binder material where the bonding effect is accomplished by heating and removing liquid solvent or dispersant from a shaped body of moist, binder coated sand particles.

Moist gelatin gel coated sand particles are poured into a mold box defining the shape of a specified foundry core or other foundry mold part. The mold box may be of multi-part construction for removal of the bonded sand core. The material of the mold is to be substantially transparent to radio frequency radiation, which will be used to dry the sand particles and bond them into a unitary body of such defined shape. Many RF-transparent commercial organic polymers and ceramic materials, for example, are available for making the mold box. Preferably, the mold box is re-usable. In order to minimize abrasion of the box it is preferred to flow the sand by gravity into cavity of the mold box from a suitable hopper. During filling and thereafter the sand is caused to fill the mold cavity and to be compacted in it by multi-axis vibration. An initially over-filled core box can be placed on a shake table activated by powerful electromagnetic vibrators to fill the cavity of the box with suitably compacted sand.

After the mold box has been suitably filled and compacted with un-bonded sand it is moved to a sand drying station. Drying is preferably accomplished in a RF oven comprising suitable ceiling and ground plane electrodes. To the extent practical in the overall core drying application, the electrodes are closely spaced on opposite sides of the mold box. Depending upon the shape of the core, it may also be desirable for the electrodes to conform generally to the outline of the core. This practice more efficiently directs electromagnetic radiation into the moist sand to dry it. The radiation readily passes through the walls of the core mold that are transparent to it and uniformly heats the water in the gel throughout the particulate sand body. Once RF heating of the water coated sand has commenced, a stream of air or other drying gas is caused to flow through the core box to carry away water vapor. The core box is provided with suitable perforations or vents to provide for air flow through the walls of the box and uniformly through the coated particulate sand mass shaped therein.

In the example of a moist gelatin gel coating, the RF heating of the gel transforms it to a gelatin solution or sol and promotes migration of the gelatin proteins to the contacting surfaces of the sand particles. This migration and the reduction of the water content of the gelatin provides a strong gelatin bond between the sand particles and forms a strong core or mold part for use in a casting operation.

As described in the Siak et al patent, gelatin is obtained from natural sources. It is water soluble and not harmful to the environment. Under the heat of a typical molten metal casting operation, there is sufficient breakdown of the gelatin bonds sustaining the core shape that the core particles can be easily removed from internal cavities of the casting. As further described in Re. U.S. Pat. No. 36,001, preferred gelatins for use as binders in particulate sand foundry mold members have "Bloom" ratings or numbers in the range of about 65 to about 175 Bloom grams.

While gelatin is a preferred binder for sand core or mold component making in accordance with this invention, other water dispersed binding materials can be used when they form core making bonds upon RF heating of the water content of the binder coated refractory particles. Examples of such binder materials are starch, sugar, gum and cellulose ethers.

These and other objects and advantages of the invention will become apparent from a detailed description of the invention which follows.

DESCRIPTION OF A PREFERRED EMBODIMENT

A novel process is described for forming sand (or other suitable refractory particle) cores used in castings such as engine blocks and heads. The method uses multi-axis vibration to fill and pack the moist pre-coated sand into the core mold and radio frequency (RF) heating to dry and strengthen the cores. A principle advantage of this method is that it does away with the large core making machinery currently used to blow sand into core pattern boxes for heat or chemical curing, and reduces considerably the capital investment for these machines. Using RF-transparent, less expensive, plastic or ceramic core boxes, it is possible to speed up the conventional core making process by making cores in a parallel flow process and greatly increase the productivity of the cored sand casting method which is widely used.

Figure 1:
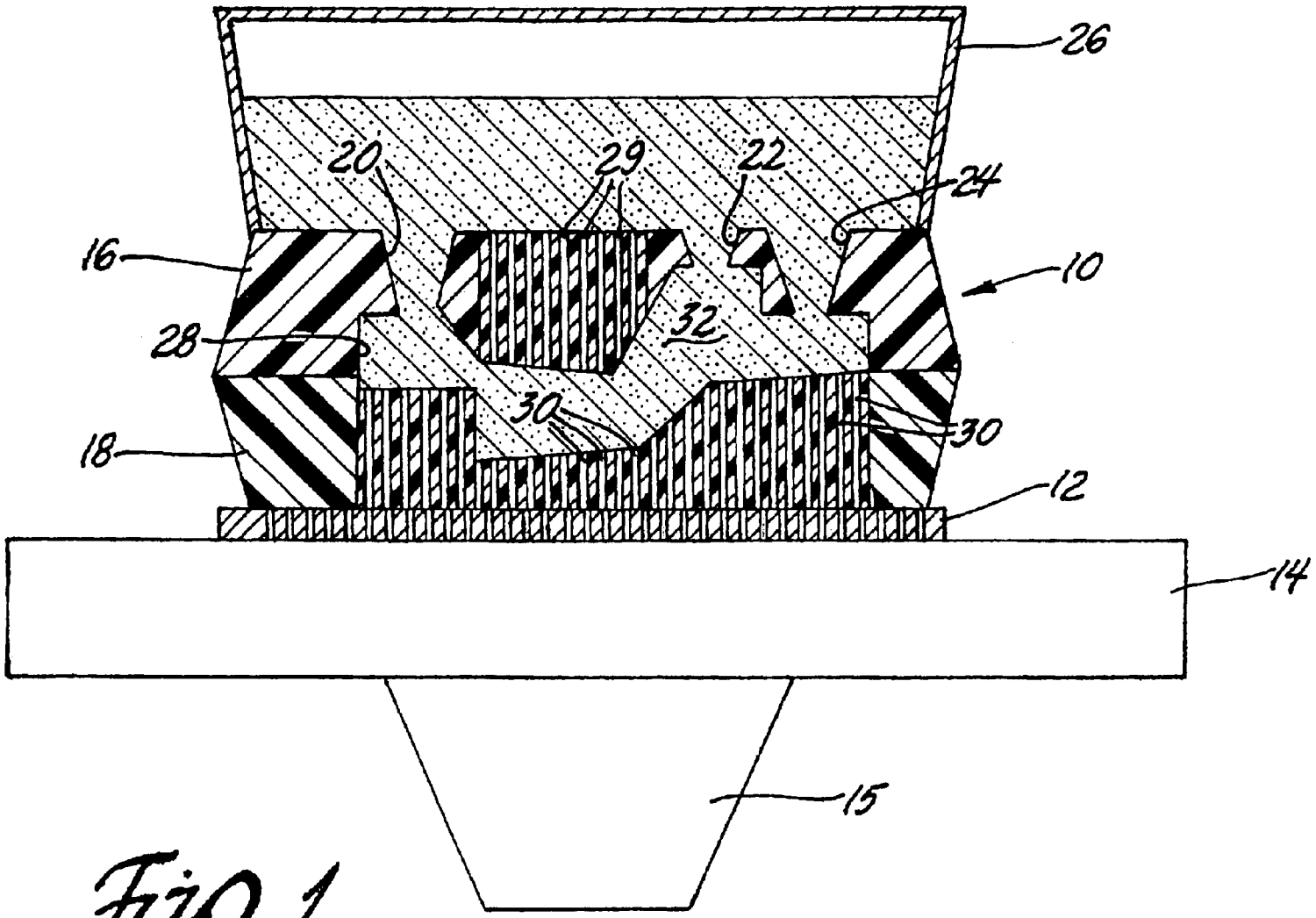
FIG. 1 is a cross sectional view of a two part core box for receiving moist, binder-coated sand from a gravity feed hopper. The core box is supported on a compaction table which is adapted for filling and compaction of the refractory particles in the cavity of the pattern box by multi-directional vibration.

In FIG. 1 a core box 10 is placed on a porous plate 12 which in turn lies on a multi-axis compaction table 14. Core box 10 is a two part pattern box comprising cope 16 and drag 18 members. Cope member 16 has fill openings 20, 22, and 24 for admitting binder coated sand particles by gravity flow from hopper 26. The bottom of hopper may be closed by a suitable shutter, not shown, when the core cavity (indicated at 28 and shown filled with refractory particles 32) is suitably filled. Alternatively, a predetermined quantity of moist, binder coated refractory particles suitable for filling the core box may be measured into hopper 26 for the filling of each core box 10.

Core box 10 is made of a suitable heat reluctant, radio frequency transparent material. Plastic resins such as polyethylene, polypropylene, polycarbonate and polystyrene are suitable as are many ceramics or glass compositions. The requirement is that the core box 10 material be sufficiently durable for gravity filling with binder coated sand particles 32 and for multi-axis vibration for complete filling of the cavity 28 of the core box 10 with the particles and compaction of the particles in the cavity 28 to porous, but void free, density. The material of the core box 10 is substantially transparent to radio frequency radiation of frequencies in the range of about ten to one hundred megahertz. RF frequency drying and/or curing of a water dispersed binder material is used as described further in this specification.

Depending upon the shape of the core to be made, both the cope 16 and drag 18 members are provided with vent passages 29, 30 suitable for the flow of air, or other drying gas, under moderate pressure for transport of water vapor during RF heating.

Thus an important aspect of this method is to fill and pack pre-coated moist sand 32 into the core box 10 by using gravity and multi-axis vibration rather than core blowing machines. The sand used for core making is coated with a gelatin binder (or other suitable water dispersed binder) and pre-moistened with water and it flows like a viscous liquid when vibrated. In the case of using a gelatin binder the selection and preparation of a preferred material is described in Re. U.S. Pat. No. 36,001 and that description is incorporated herein by reference.

Suitable multi-axis vibration by compaction table 14 quickly fills sand into incredibly small passages, producing very dense packing in a matter of seconds. Vigorous three-axis vibration is produced by powerful electromagnetic vibrators (in commercially available shake mechanism 15) below compaction table 14 or temporarily attached to the sides of the core box 10. Shaking along two or three different axes (referring, e.g., to a mutually orthogonal, three axis system) assures that the sand 32 will migrate vigorously in any filling direction and that once the cavity 28 is filled, sand will impact vigorously against the side of the cavity 28 causing it to pack and fill-in any cavities of trapped air. Once filled and packed, the core box 10 can be moved to another station and additional core boxes filled. The core filling is accomplished without high pressure blowing of sand and with minimal erosion to the inner surfaces of the mold because vibration was used.

In conventional core making, the binder coated sand cores are also set or hardened in the core machine by application of heat or chemical curing agent. This practice ties up the expensive and complicated sand blowing and curing machine for more time. In the process of this invention, multiple, less expensive plastic core boxes could be filled and packed by vibration using less expensive equipment. The filled boxes can then be queued and run through a RF drying oven quickly and with several at one time. Thus a sequential batch-type process of core making has now become a parallel process in which the two major steps are decoupled.

Drying or hardening of the moist, binder coated sand core is accomplished in an open (door less) RF oven tuned to deliver energy at a frequency that heats the small amount of water mixed with the gelatin binder material. The oven is represented schematically in FIG. 2. The sand filled core box 10 still carried on porous plate 12 is now positioned between ground RF electrode or antenna plate 34 and ceiling RF electrode or antenna 36. In general, for rapid heating it is preferred that the antennae 34, 36 are closely spaced to core box 10. The electromagnetic energy frequency is applied at a frequency in the range of about 10 to 100 MHz. For automotive engine cores a frequency of about 18 MHz at a potential of about 6 kv or higher has been suitable for activation and drying of gelatin gel coated sand particles.

The input of RF energy is indicated schematically by arrows 46 from ceiling electrode 36. However, the RF frequency energy goes into the sand core(s) load within the oven and does not broadcast outside the oven and around the work area. Doors are not required on the oven, nor is elaborate electromagnetic shielding required. Very little current is drawn in the RF generator when no load is present in the oven. Normally, loads such as these core boxes would travel through the oven on a slow moving conveyor belt.

Drying is accomplished because the RF energy penetrates the transparent plastic core box 10 without heating it, penetrates the sand 32 because it is mostly silica, and heats the water used to moisten the gelatin coating on the sand grains. The warmed gelatin gel becomes a solution (sometimes referred to as melting or activation) that, propelled by surface tension, flows over the sand grains and accumulates at their contact points. Then, additional RF energy evaporates water from the binder, leaving it a hard, dry plastic-like material that binds the sand grains together.

Figure 2:
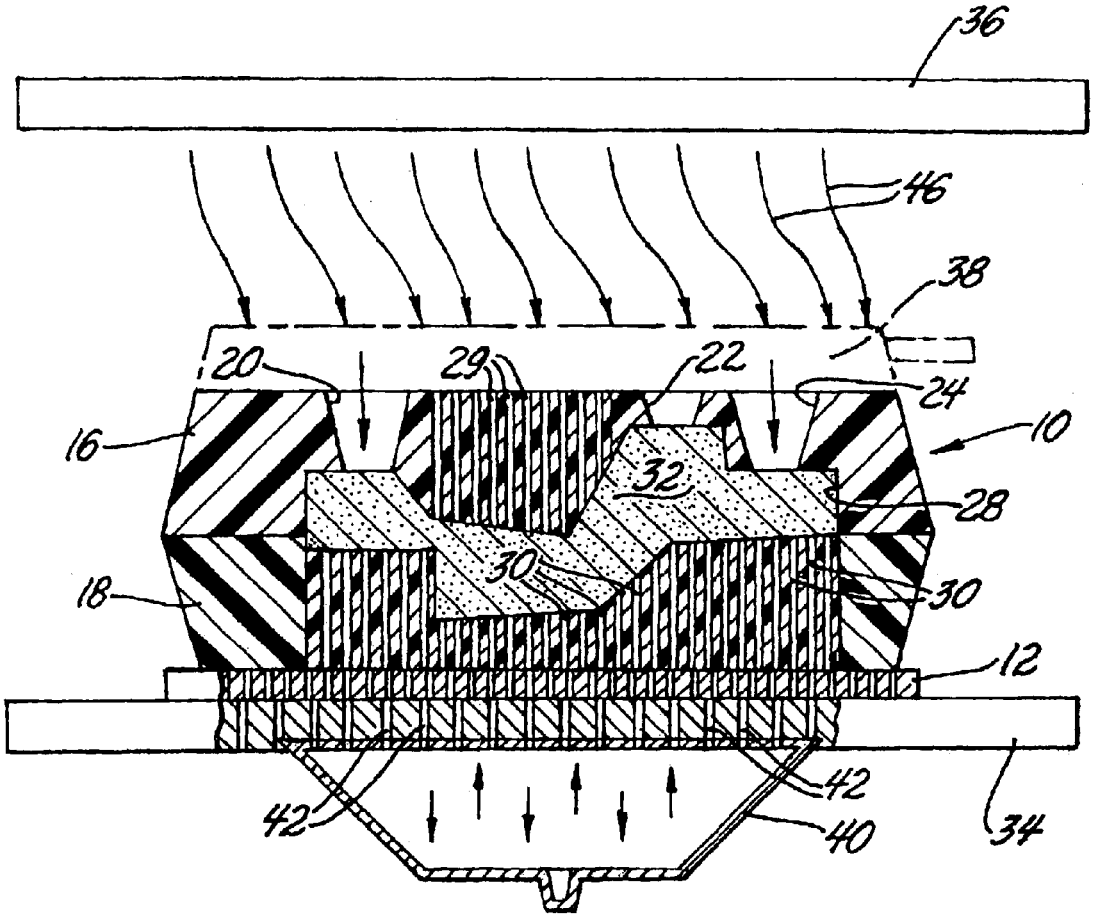
FIG. 2 is a cross sectional view of the sand filled core box of FIG. 1 positioned between a ground electrode plate and a ceiling electrode for radio frequency heating of the moist sand. Means is provided for blowing or drawing air through the sand core as it is heated by the electromagnetic energy.

The process is enhanced if a small amount of airflow is used to draw the water vapor away from the sand and out of the core box. This can be accomplished by either drawing a partial vacuum on the core box or by pushing a small amount of dry compressed air through the box after the water begins to evaporate from heating. As illustrated in FIG. 2, an air plenum 38, transparent to RF radiation, is placed over the top of core box 10. Plenum 38 covers sand fill openings 20, 22, 24 and cope vent 29. Another air plenum 40 is placed below ground antenna plate 34. Ground antenna plate 34 has air passages 42 permitting the flow of air through antenna 34. Air flow arrows in lower plenum 40 indicate that the flow of drying gas may be upward or downward through the horizontally disposed core cavity 28. However, it is generally preferred that the flow be downward as indicated in cope fill openings 20 and 24 to continue to compact the sand mass 32 in cavity 28.

Figure 3:
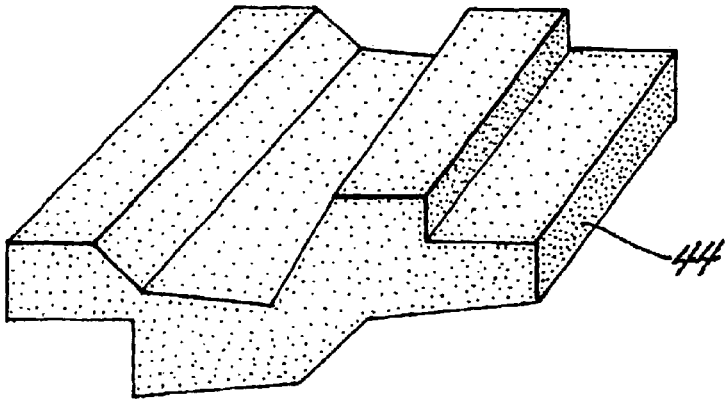
FIG. 3 is a perspective view of a dried gelatin bonded sand core made in accordance with this invention.

Finally the dry bonded core 44 (FIG. 3) is removed from the core box 10 by separation of cope 16 and drag 18 members after the core 44 is fully strengthened and hardened. The core box 10 is reassembled and refilled with moist gelatin coated sand to begin the cycle again.

As stated, there are two reasons for heating the moist gelatin coated sand core in the mold. The heating activates the moist gelatin by converting the gel to a solution which can flow to the junctions of the sand particles. Secondly, the heating evaporates the coating to dryness. The dry binder is then at maximal strength. Since the moisture comes from the water in the binder which is dispersed over each sand grain, RF heating is an ideal mechanism for delivering heat deep into the core object, much better than the previous methods of using conduction from the inner surfaces of an externally heated metal box.

In an illustrative example of a 2.75 inch thick core, 60 seconds of RF core heating was used in which a mild vacuum was pulled on the core box beginning after 30 seconds of heating. The temperature rises as the water in the coating absorbs energy and heats the surrounding sand. The flow of air after 30 seconds pulls off the heated water trapped in the matrix of sand and the temperature rise is halted. However the dried sand remains warm because the heat from the water is now transferred to the sand which has a large thermal mass and only cools slowly from the small air flow. The tensile strength of cores typically is in the range of about 200 to 300 psi.

The invention has been described in terms of a specific example of a specific core shape and using silica sand and a gelatin gel binder. As stated other sand-like materials can be used. While water is the preferred solvent or dispersant for the binder, other liquids heatable with RF energy such as methyl or ethyl alcohol may be suitable. Thus, it is apparent that other embodiments of the invention could readily be adapted by one skilled in the art. The scope of the invention is not limited to such illustrations.

What is claimed:

1. A method of making a bonded, sand particle foundry mold member, said method comprising:

introducing sand particles into the cavity of a mold box such that the impact of said particles on said cavity does not substantially exceed an impact due to gravity filling of said particles, said cavity defining the shape of said foundry mold member, said sand particles being coated with a liquid dispersed binder that is hardenable upon evaporation of said liquid, said mold box being formed of a material that is transparent to radio frequency electromagnetic radiation, vibrating said mold box to compact said particles in said cavity;

heating said liquid in said cavity with radio frequency electromagnetic radiation; and during said heating flowing a gas through said particles in said cavity to transport heated liquid from said particles to harden said binder and bond said particles into said foundry mold member.

2. A method as recited in claim 1 in which said binder comprises a dispersion of gelatin in water and the frequency of said radiation is in the range of ten to one hundred megahertz.

3. A method as recited in claim 2 in which said binder consists essentially of a sol of gelatin in water, said gelatin having a Bloom rating in the range of about 65 to about 175 Bloom grams.

4. A method as recited in claim 1 in which said flow of gas is commenced after the commencement of said radio frequency heating.

5. A method as recited in claim 1 in which said gas is air.

6. A method as recited in claim 1 comprising introducing said particles into said cavity and vibrating said mold box at a first work station and, thereafter, moving said mold box to a second work station for said heating and transport of said liquid.

7. A method as recited in claim 1 comprising vibrating said mold box in at least two orthogonal directions to compact said particles.

8. A method of making a gelatin bonded, sand particle foundry mold member, said method comprising:

introducing sand particles into the cavity of a mold box such that the impact of said particles on said cavity does not substantially exceed an impact due to gravity filling of said particles, said cavity defining the shape of said foundry mold member, said sand particles being coated with a water dispersed gelatin binder, said mold box being formed of a material that is transparent to radio frequency electromagnetic radiation;

vibrating said mold box to compact said particles in said cavity;

heating said water in said cavity with radio frequency electromagnetic radiation; and during said heating flowing a gas through said particles in said cavity to transport heated water from said particles to harden said gelatin binder and bond said particles into said foundry mold member.

9. A method as recited in claim 8 in which said binder consists essentially of a sol of gelatin in water, said gelatin having a Bloom rating in the range of about 65 to about 175 Bloom grams.

10. A method as recited in claim 8 in which the frequency of said radiation is in the range of ten to one hundred megahertz.

11. A method as recited in claim 8 in which said gas is air.

12. A method as recited in claim 11 in which the flow of air is commenced after the commencement of said radio frequency heating.

13. A method as recited in claim 8 comprising introducing said particles into said cavity and vibrating said mold box at a first work station and, thereafter, moving said mold box to a second work station for said heating and transport of said water.

14. A method as recited in claim 8 comprising vibrating said mold box in at least two orthogonal directions to compact said particles.

* * * * *